US011143406B2

(12) United States Patent
Prociw et al.

(10) Patent No.: US 11,143,406 B2
(45) Date of Patent: Oct. 12, 2021

(54) FUEL INJECTORS HAVING AIR SEALING STRUCTURES

(71) Applicant: Delavan, Inc., West Des Moines, IA (US)

(72) Inventors: Lev Alexander Prociw, Johnston, IA (US); Jason A. Ryon, Carlisle, IA (US); Gregory A. Zink, Des Moines, IA (US)

(73) Assignee: Delavan Inc., West Des Moines, IA (US)

( * ) Notice: Subject to any disclaimer, the term of this patent is extended or adjusted under 35 U.S.C. 154(b) by 281 days.

(21) Appl. No.: 15/949,787

(22) Filed: Apr. 10, 2018

(65) Prior Publication Data

US 2019/0309950 A1 Oct. 10, 2019

(51) Int. Cl.

| | |
|---|---|
| ***F23R 3/60*** | (2006.01) |
| ***F23R 3/28*** | (2006.01) |
| ***F23R 3/30*** | (2006.01) |

(52) U.S. Cl.

CPC ..... *F23R 3/283* (2013.01); *F23R 3/286* (2013.01); *F23R 3/30* (2013.01); *F23R 3/60* (2013.01); *F23D 2900/11101* (2013.01)

(58) Field of Classification Search

None

See application file for complete search history.

(56) References Cited

U.S. PATENT DOCUMENTS 2,449,541 A * 9/1948 Arno ..... B60K 15/04 141/35
3,972,182 A * 8/1976 Salvi ..... F23D 11/105 60/743
4,454,711 A * 6/1984 Ben-Porat ..... F23R 3/60 60/800
4,735,044 A * 4/1988 Richey ..... F02C 7/22 239/424
5,044,559 A * 9/1991 Russell ..... F23D 11/107 239/406

(Continued)

FOREIGN PATENT DOCUMENTS

| | | | | |
|---|---|---|---|---|
| EP | 1811229 A2 * | 7/2007 | ..... | F23D 11/383 |
| EP | 3156732 A1 | 4/2017 | | |
| GB | 688162 A * | 2/1953 | ..... | F16N 3/08 |

OTHER PUBLICATIONS

Extended European search report issued in corresponding EP patent application No. 19167643.6 dated Jul. 26, 2019.

*Primary Examiner* — Gerald L Sung
*Assistant Examiner* — Marc J Amar
(74) *Attorney, Agent, or Firm* — Locke Lord LLP; Daniel J. Fiorello; Gabrielle L. Gelozin

(57) ABSTRACT

A fuel injector for a turbomachine includes an outer heat shield configured to sit on and/or within a combustor dome to orient the fuel injector relative to the combustor dome and/or a fuel manifold. An inner surface of the outer heat shield includes an outer heat shield seal surface. The injector also includes a fuel prefilmer seated at least partially within the outer heat shield. An outer surface of the fuel prefilmer includes a prefilmer seal surface configured to mate with the outer heat shield seal surface such that the fuel prefilmer seats on the outer heat shield seal surface and such that the prefilmer seal surface is configured to allow the surfaces to slide relative to one another in both a radial and axial direction.

18 Claims, 3 Drawing Sheets

(56) References Cited

U.S. PATENT DOCUMENTS 6,076,356 A * 6/2000 Pelletier ..... F23D 11/107 60/740
6,199,367 B1 * 3/2001 Howell ..... F23D 11/24 239/402.5
6,212,870 B1 * 4/2001 Thompson ..... F23R 3/14 60/746
6,276,141 B1 * 8/2001 Pelletier ..... F23D 11/107 60/740
6,415,610 B1 * 7/2002 Parker ..... F01D 25/28 60/748
8,516,830 B2 * 8/2013 Duval ..... F23R 3/283 60/740
10,196,983 B2 * 2/2019 Cadman ..... F02C 7/24
2002/0125336 A1 * 9/2002 Bretz ..... F23D 11/107 239/8
2002/0134084 A1 * 9/2002 Mansour ..... F23D 11/107 60/740
2003/0196440 A1 10/2003 Steinthorsson et al.
2004/0129001 A1 * 7/2004 Lehtinen ..... F23D 11/107 60/740
2007/0137208 A1 * 6/2007 Prociw ..... F23R 3/14 60/748
2009/0044538 A1 * 2/2009 Pelletier ..... F23R 3/14 60/740
2009/0255258 A1 * 10/2009 Bretz ..... F23D 11/107 60/737
2009/0277176 A1 11/2009 Caples
2009/0308957 A1 * 12/2009 Hall ..... F23D 11/38 239/590
2010/0251720 A1 * 10/2010 Pelletier ..... F23D 11/107 60/740
2010/0307159 A1 * 12/2010 Toon ..... F23D 11/38 60/746
2010/0307161 A1 * 12/2010 Thomson ..... F23D 11/107 60/748
2013/0042625 A1 * 2/2013 Barker ..... F23R 3/286 60/778
2013/0189115 A1 * 7/2013 Everett ..... C23C 14/042 416/241 R
2014/0158796 A1 * 6/2014 Buelow ..... F23R 3/28 239/468
2014/0245742 A1 * 9/2014 Chew ..... F23R 3/14 60/748
2014/0339339 A1 * 11/2014 Prociw ..... F23R 3/28 239/406
2016/0290291 A1 * 10/2016 Prociw ..... F23R 3/14
2016/0290649 A1 * 10/2016 Prociw ..... F23R 3/286
2016/0298848 A1 * 10/2016 Geary ..... F02C 7/222
2017/0122212 A1 * 5/2017 Cadman ..... F02C 7/24
2019/0249869 A1 * 8/2019 Glover ..... F23R 3/283
2020/0063968 A1 * 2/2020 Gutmark ..... F23R 7/00

* cited by examiner

FUEL INJECTORS HAVING AIR SEALING STRUCTURES

BACKGROUND

1. Field

The present disclosure relates to turbomachines, more specifically to fuel injectors (e.g., also referred to as fuel nozzles) for turbomachines.

2. Description of Related Art

Multipoint fuel injection systems would benefit from a simple, low cost fuel injector construction to permit a large number of injectors to be used. Traditional fuel injector/nozzle designs are complex.

Such conventional methods and systems have generally been considered satisfactory for their intended purpose. However, there is still a need in the art for improved fuel injectors. The present disclosure provides a solution for this need.

SUMMARY

A fuel injector for a turbomachine includes an outer heat shield configured to sit on and/or within a combustor dome to orient the fuel injector relative to the combustor dome and/or a fuel manifold. An inner surface of the outer heat shield includes an outer heat shield seal surface. The injector also includes a fuel prefilmer seated at least partially within the outer heat shield. An outer surface of the fuel prefilmer includes a prefilmer seal surface configured to mate with the outer heat shield seal surface such that the fuel prefilmer seats on the outer heat shield seal surface and such that the prefilmer seal surface is configured to allow the surfaces to slide relative to one another in both a radial and axial direction.

The outer heat shield seal surface and the prefilmer seal surface can be frustoconical shaped. The outer heat shield seal surface and the prefilmer seal surface can be linear such that the outer heat shield and the prefilmer linearly reduce in inner diameter. For example, the outer heat shield seal surface and the prefilmer seal surface can be ramp shaped.

The injector can include a fuel distributor seated on and/or at least partially within the fuel prefilmer. An inner surface of the fuel distributor can include a distributor seal surface.

The injector can include an inner heat shield seated at least partially within the fuel distributor. An outer surface of the inner heat shield can include an inner heat shield seal surface configured to mate with the distributor seal surface such that the inner heat shield seats on the distributor seal surface and such that the inner heat shield seal surface is configured to slide relative to the distributor seal surface.

The distributor seal surface and the inner heat shield seal surface can be frustoconical shaped. The distributor seal surface and the inner heat shield seal surface can be linear such that the distributor and the inner heat shield linearly reduce in inner diameter. For example, the distributor seal surface and the inner heat shield seal surface can be ramp shaped.

The inner heat shield seal surface can be formed on an outer diameter protrusion of the inner heat shield. The outer heat shield can include bayonet clip flanges. The inner heat shield can be retained to the outer heat shield via the bayonet clip flanges.

The outer heat shield can include a plurality of standoff features to orient the fuel injector on or within the combustor dome and/or the fuel manifold. The outer heat shield can include three standoff features.

The inner heat shield can include an inner air swirler formed from, disposed within, or attached to the inner heat shield. The fuel distributor can include one or more threads at a downstream end thereof. The threads of the fuel distributor and the prefilmer can define one or more fuel distribution channels therebetween. The outer heat shield and inner heat shield can be made of a different material than the fuel distributor and the prefilmer. In operation, the sealing surfaces can seal to one another, for example. The sealing surfaces can cause improved sealing as a function of pressure differentials.

In accordance with at least one aspect of this disclosure, a method of sealing fluid flow in a fuel injector can include seating a fuel prefilmer at least partially within an outer heat shield of the fuel injector such that a prefilmer seal surface of the fuel prefilmer and an outer heat shield seal surface of the fuel injector are allowed to slide relative to one another in both a radial and axial direction.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
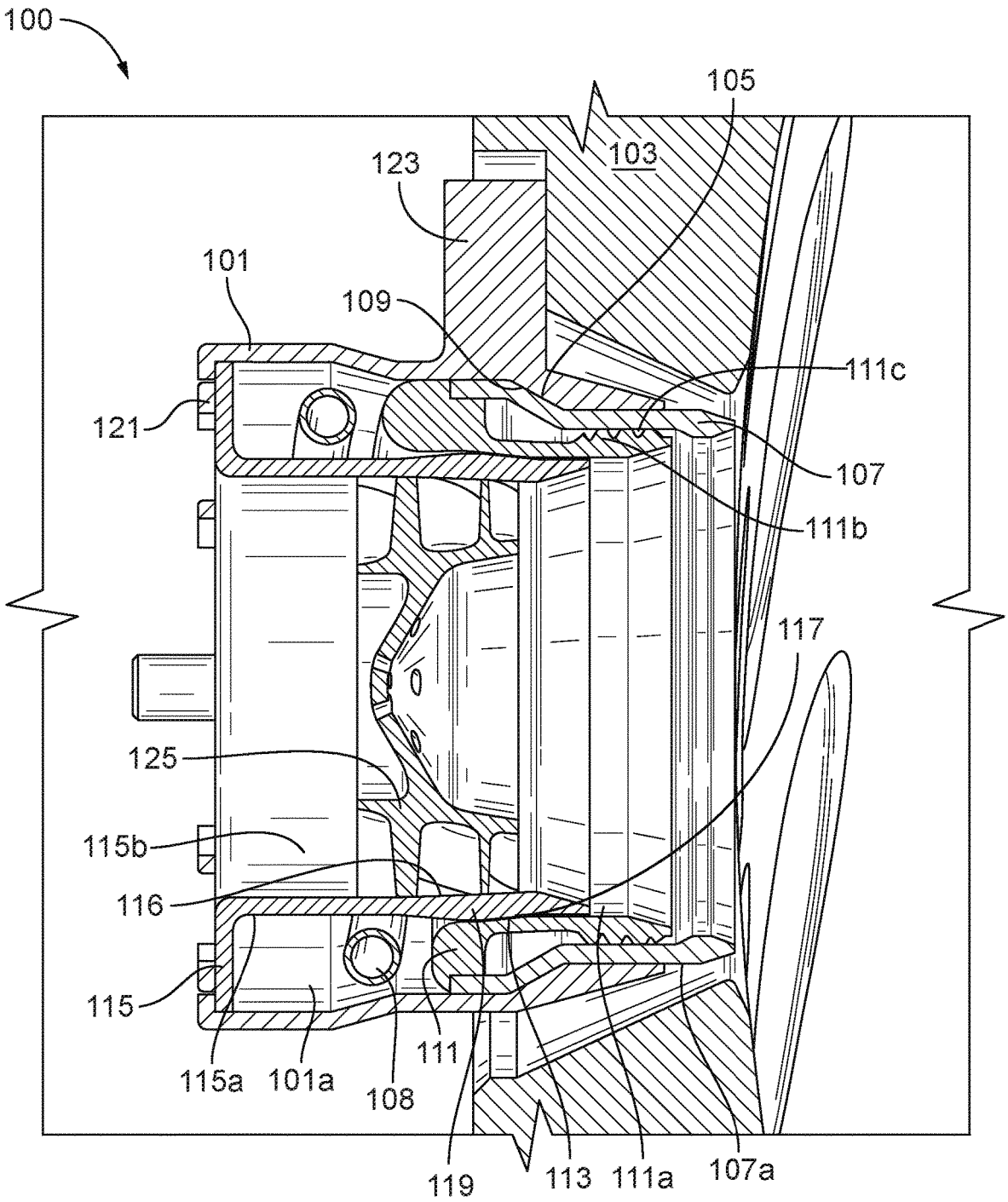
FIG. 1 is a cross-sectional view of an embodiment of a fuel injector in accordance with this disclosure.
Figure 2:
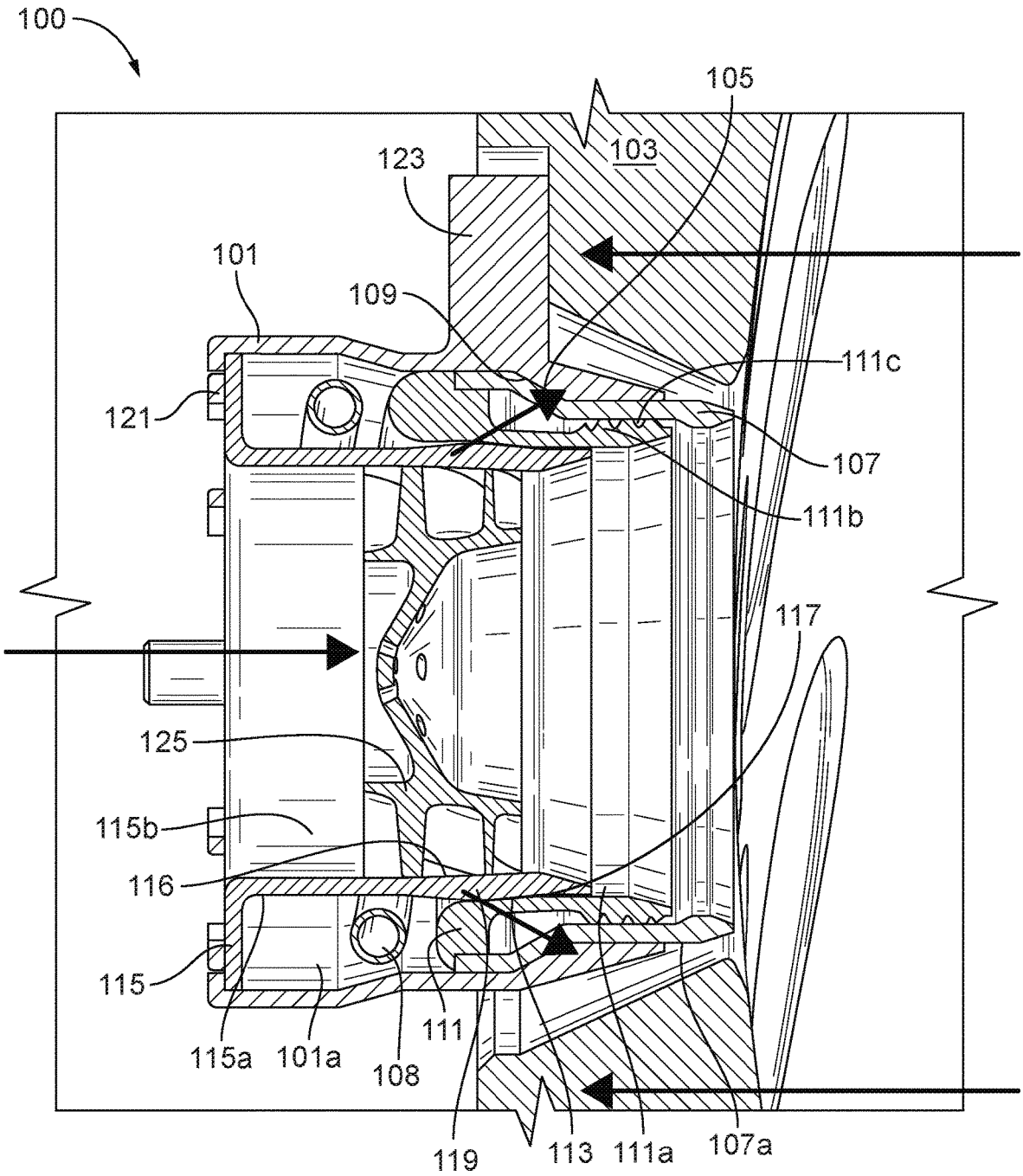
FIG. 2 is a cross-sectional view of an embodiment of a fuel injector in accordance with this disclosure, showing force distribution during operation.

Reference will now be made to the drawings wherein like reference numerals identify similar structural features or aspects of the subject disclosure. For purposes of explanation and illustration, and not limitation, an illustrative view of an embodiment of a fuel injector in accordance with the disclosure is shown in FIG. 1 and is designated generally by reference character 100. Other embodiments and/or aspects of this disclosure are shown in FIGS. 2 and 3.

Figure 3:
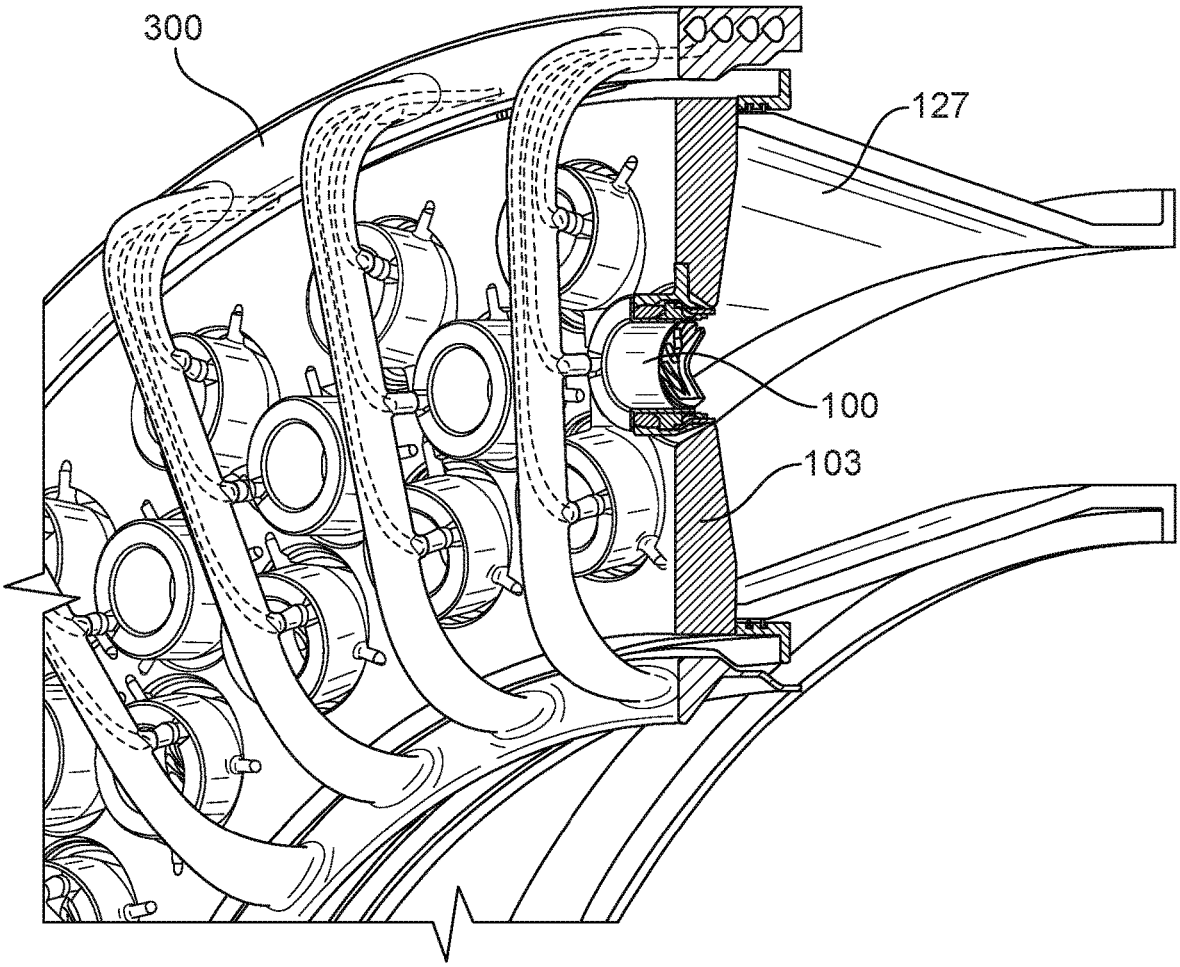
FIG. 3 is a partial perspective cross-sectional view of a multipoint injection and combustor system in accordance with this disclosure.

A fuel injector 100 for a turbomachine includes an outer heat shield 101 configured to sit on and/or within a combustor dome 103 to orient the fuel injector 100 relative to the combustor dome 103 and/or a fuel manifold (e.g., fuel manifold 300 as shown in FIG. 3). An inner surface 101*a* of the outer heat shield 101 includes an outer heat shield seal surface 105. The injector 100 also includes a fuel prefilmer 107 seated at least partially within the outer heat shield 101. An outer surface 107*a* of the fuel prefilmer 107 includes a prefilmer seal surface 109 configured to mate with the outer heat shield seal surface 105 such that the fuel prefilmer 107 seats on the outer heat shield seal surface 105 and such that the prefilmer seal surface 109 is configured to allow the surfaces to slide relative to one another (e.g., to allow relative movement between the outer heat shield 101 and the prefilmer 107 during operation due to relative thermal growth).

The surfaces 105, 109 can slide in both a radial and axial direction, for example (e.g., directed by a conical shape). For example, in certain embodiments, if the prefilmer 107 were to thermally grow relative to the outer heat shield 101, the prefilmer 107 would slide on axially forward/upstream and radially outward and maintain contact with the outer heat shield 101, and vice versa for thermal shrinking while still maintaining contact.

As shown, the outer heat shield seal surface 105 and the prefilmer seal surface 109 can be frustoconical shaped. The outer heat shield seal surface 105 and the prefilmer seal surface 109 can be conical such that the outer heat shield 101 and the prefilmer 107 linearly reduce in inner diameter. For example, the outer heat shield seal surface 105 and the prefilmer seal surface 109 can be ramp shaped. In certain embodiments, non-conical surfaces 105, 109 can be used.

The injector 100 can include a fuel distributor 111 seated on and/or at least partially within the fuel prefilmer 107. An inner surface 111*a* of the fuel distributor 111 can include a distributor seal surface 113. The fuel distributor 111 can be brazed to the prefilmer 107, and/or connected in any suitable manner.

The injector 100 can include an inner heat shield 115 seated at least partially within the fuel distributor 111. An outer surface 115*a* of the inner heat shield 115 can include an inner heat shield seal surface 117 configured to mate with the distributor seal surface 113 such that the inner heat shield 115 seats on the distributor seal surface 113 and such that the inner heat shield seal surface 117 is configured to slide relative to the distributor seal surface 113 (e.g., to allow relative movement therebetween during operation due to relative thermal growth).

The distributor seal surface 113 and the inner heat shield seal surface 117 can be frustoconical shaped as shown. The distributor seal surface 113 and the inner heat shield seal surface 117 can be conical such that the distributor 111 and the inner heat shield 115 linearly reduce in diameter. For example, the distributor seal surface 113 and the inner heat shield seal surface 117 can be ramp shaped. In certain embodiments, non-conical surfaces 113, 117 can be used.

In certain embodiments, the inner heat shield seal surface 117 can be formed on an outer diameter protrusion 119 of the inner heat shield 115. The outer diameter protrusion 119 can axially increase in diameter on the inner heat shield 115 until the inner heat shield seal surface 117 which can reduce in outer diameter from a peak of the outer diameter protrusion 119.

In certain embodiments, the outer heat shield 101 can include bayonet clip flanges 121. The inner heat shield 115 can be retained to the outer heat shield via the bayonet clip flanges 121. For example, the inner heat shield 115 can include suitable openings on an upstream flange thereof configured to allow the bayonet clip flanges 121 to pass therethrough to allow insertion of the inner heat shield 115 into the outer heat shield 101. Thereafter, rotation of the inner heat shield 115 relative to the outer heat shield 101 can engage the bayonet clip flanges 121 to the inner heat shield 115 in any suitable manner. Any other suitable connection type and/or installation of the inner heat shield 115 within the outer heat shield 101 is contemplated herein.

The outer heat shield can include a plurality of standoff features 123 to orient the fuel injector 100 on or within the combustor dome 103 and/or the fuel manifold. For example, the outer heat shield 101 can include three or more standoff features 123.

The inner heat shield 115 can include an inner air swirler 125 formed from, disposed within, or attached to the inner heat shield 115. In certain embodiments, as shown, an inner diameter 115*b* of the inner heat shield 115 can include an engagement interface 116 to engage the air swirler 125. The engagement interface 116 can include a sealing surface with the inner air swirler 125 similar to the seal surfaces described above (e.g., frustoconical).

The fuel distributor 111 can include one or more threads 111*b* at a downstream end thereof. The threads 111*b* of the fuel distributor and the prefilmer 107 can define one or more fuel distribution channels 111*c* therebetween.

The outer heat shield 101 and inner heat shield 115 can be made of a different material than the fuel distributor 111 and the prefilmer 107. For example, the outer heat shield 101 and inner heat shield 115 can be made of a composite, low alpha material and the fuel distributor 111 and the prefilmer 107, and associated fuel tube 108 can be made of metal. Such material difference can cause relative thermal movement during operation. The fuel tube 108 can be coiled and act like a spring to apply force to the fuel distributor.

Referring additionally to FIGS. 2 and 3, embodiments include a low temperature liquid fuel distributor and a high temperature outer and inner heat shield components, e.g., together with a coil fuel feed tube. In embodiments, the heat shield takes on a number of functions. To permit thermal variation in temperature, air seals between the fuel distributor and heat shield can be formed between conical features which can adapt to changes in temperature between the components. The seals are energized by the air pressure across the combustor 127 which helps compress the element together to form the conical seals. The geometry of the seals help reduce the part count for the injector 100 while permitting the hot and cold elements to work together.

In operation, the sealing surfaces can seal to one another. The sealing surfaces can cause improved sealing as a function of pressure differentials.

In accordance with at least one aspect of this disclosure, a method of sealing fluid flow in a fuel injector can include seating a fuel prefilmer at least partially within an outer heat shield of the fuel injector such that a prefilmer seal surface of the fuel prefilmer and an outer heat shield seal surface of the fuel injector are allowed to slide relative to one another in both a radial and axial direction.

Conventional air blast fuel injectors incorporate an outer air shroud, one or more outer air swirler arrays, outer heat shield, inner heat shield and an inner air swirler with an annular fuel distributer between the outer and inner air flow passages. Embodiments admit more air flow though the combustor dome to increase the combustor backside cooling effectiveness of the nozzle air while eliminating many outer air features with their functions taken over by embodiments of a combustor wall and one or more heat shields. For example, the standoff features 123 can be configured to provide an air metering function (e.g., through a gap between the fuel injector 100 and the combustor 103). The standoff features can also act to position the assembly concentrically with the combustor opening, for example.

Embodiments can include conical interfaces that allow air seals to be located between the fuel distributer and heat shields without welding or brazing. In certain embodiments, a cavity between heat shield components can form a heat protection for the cooled fuel feed tube. The core air swirler can also be retained by a conical interface and possibly brazed as well. Low alpha materials for the heat shields (e.g., and inner air swirler) can minimize thermal fight.

Embodiments prevent air leaks in the air swirler without having to braze heat shields to fuel components. Embodiments include a bayonet retainer that can be pinned after insertion to prevent the inner heat shield from rotating back out of the out heat shield. Compression from air pushing into hole where fuel tube enters through the inner heat shield and/or from a spring shaped fuel tube can push conical interfaces together to seal. The seals are free to slide to adjust to thermal variations. The standoffs can present the load to the combustor dome which is supported to the engine case. The conical surfaces can provide an adequate air seal so that air which comes internal to the nozzle (e.g., through the fuel tube inlet in the upstream flange of the inner heat shield) is restricted from being able to pass uncontrollably between the heat shields and the fuel components.

Embodiments includes multipoint lean direct injection systems that can account for most if not all air through the system to ensure it is being used as efficiently as possible to mix with the fuel. Multipoint fuel injection requires many fuel injection nozzles to be effective. Embodiments provide nozzles that can be low cost and lighter weight. Embodiments helps reduce the nozzle parts count and braze/weld joints while providing air meter and heat shielding functions.

Any suitable combination(s) of any disclosed embodiments and/or any suitable portion(s) thereof is contemplated therein as appreciated by those having ordinary skill in the art.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A fuel injector for a turbomachine, comprising:

an outer heat shield configured to sit on and/or within a combustor dome to orient the fuel injector relative to the combustor dome and/or a fuel manifold, wherein an inner surface of the outer heat shield includes an outer heat shield seal surface;

a fuel prefilmer seated at least partially within the outer heat shield, wherein an outer surface of the fuel prefilmer includes a prefilmer seal surface configured to mate with the outer heat shield seal surface such that the fuel prefilmer seal surface seats on, and in contact with, the outer heat shield seal surface and such that the prefilmer seal surface is configured to avow the seal surfaces to slide in contact relative to one another in both a radial and axial direction at a location upstream of a downstream end of an inner heat shield;

a fuel distributor seated on and/or at least partially within the fuel prefilmer, wherein an inner surface of the fuel distributor includes a distributor seal surface; and the inner heat shield seated at least partially within the fuel distributor, wherein an outer surface of the inner heat shield includes an inner heat shield seal surface configured to mate with the distributor seal surface such that the inner heat shield seats on the distributor seal surface and such that the inner heat shield seal surface is configured to slide relative to the distributor seal surface.

2. The fuel injector of claim 1, wherein the outer heat shield seal surface and the prefilmer seal surface are frustoconical shaped.

3. The fuel injector of claim 1, wherein the distributor seal surface and the inner heat shield seal surface are frustoconical shaped.

4. The fuel injector of claim 3, wherein the inner heat shield seal surface is formed on an outer diameter protrusion of the inner heat shield.

5. The fuel injector of claim 4, wherein the outer heat shield includes bayonet clip flanges.

6. The fuel injector of claim 5, wherein the inner heat shield is retained to the outer heat shield via the bayonet clip flanges.

7. The fuel injector of claim 6, wherein the outer heat shield includes a plurality of standoff features to orient the fuel injector on or within the combustor dome and/or the fuel manifold.

8. The fuel injector of claim 7, wherein the outer heat shield includes three standoff features.

9. The fuel injector of claim 8, further comprising an inner air swirler formed from, disposed within, or attached to the inner heat shield.

10. The fuel injector of claim 9, wherein the fuel distributor includes one or more threads at a downstream end thereof.

11. The fuel injector of claim 10, wherein the threads of the fuel distributor and the prefilmer define one or more fuel distribution channels therebetween.

12. The fuel injector of claim 8, wherein the outer heat shield and inner heat shield are made of a different material than the fuel distributor and the prefilmer.

13. The fuel injector of claim 1, wherein the sealing surfaces seal to one another.

14. The fuel injector of claim 1, wherein the sealing surfaces cause improved sealing as a function of pressure differentials.

15. The fuel injector of claim 1, wherein an upstream axial portion of the fuel prefilmer is in contact with the outer heat shield.

16. A method of sealing fluid flow in a fuel injector for a turbomachine, comprising: seating a fuel prefilmer at least partially within an outer heat shield of the fuel injector such that a prefilmer seal surface of the fuel prefilmer seats on, configured to mate with, and in contact with, an outer heat shield sea surface of the fuel injector such that the prefilmer seal surface is configured to avow the seal surfaces to slide in contact relative to one another in both a radial and axial direction at a location upstream of a downstream end of an inner heat shield;

wherein an inner surface of the outer heat shield includes the outer heat shield seal surface, wherein an outer surface of the fuel prefilmer includes the prefilmer seal surface, wherein the fuel injector further comprises a fuel distributor seated on and/or at least partially within the fuel prefilmer, wherein an inner surface of the fuel distributor includes a distributor seal surface, wherein the inner heat shield is seated at least partially within the fuel distributor, wherein an outer surface of the inner heat shield includes an inner heat shield seal surface configured to mate with the distributor seal surface such that the inner heat shield seats on the distributor seal surface and such that the inner heat shield seal surface is configured to slide relative to the distributor seal surface, and wherein the outer heat shield is configured to sit on and/or within a combustor dome to orient the fuel injector relative to the combustor dome and/or a fuel manifold.

17. A fuel injector for a turbomachine, comprising:

an outer heat shield configured to sit on and/or within a combustor dome to orient the fuel injector relative to the combustor dome and/or a fuel manifold, wherein the outer heat shield includes a combustor mounting structure and wherein an inner surface of the outer heat shield includes an outer heat shield seal surface;

a fuel prefilmer seated at least partially within the outer heat shield, wherein an outer surface of the fuel prefilmer includes a prefilmer seal surface configured to mate with the outer heat shield seal surface such that the fuel prefilmer seats on the outer heat shield seal surface and such that the prefilmer seal surface is configured to avow the seal surfaces to slide relative to one another in both a radial and axial direction at a location u stream of a downstream end of an inner heat shield;

a fuel distributor seated on and/or at least partially within the fuel prefilmer, wherein an inner surface of the fuel distributor includes a distributor seal surface; and the inner heat shield seated at least partially within the fuel distributor, wherein an outer surface of the inner heat shield includes an inner heat shield seal surface configured to mate with the distributor seal surface such that the inner heat shield seats on the distributor seal surface and such that the inner heat shield seal surface is configured to slide relative to the distributor seal surface.

18. The fuel injector of claim 17, wherein the combustor mounting structure includes a plurality of standoff features to orient the fuel injector on or within the combustor dome and/or the fuel manifold.

* * * * *